US007525294B2

(12) United States Patent
Messager

(10) Patent No.: US 7,525,294 B2
(45) Date of Patent: Apr. 28, 2009

(54) HIGH-VOLTAGE REGULATOR SYSTEM COMPATIBLE WITH LOW-VOLTAGE TECHNOLOGIES AND CORRESPONDING ELECTRONIC CIRCUIT

(75) Inventor: Philippe Messager, Nauves sur loire (FR)

(73) Assignee: Atmel Nantes SA, Nantes (FR)

( * ) Notice: Subject to any disclaimer, the term of this patent is extended or adjusted under 35 U.S.C. 154(b) by 411 days.

(21) Appl. No.: 11/303,739

(22) Filed: Dec. 15, 2005

(65) Prior Publication Data

US 2006/0170407 A1 Aug. 3, 2006

(30) Foreign Application Priority Data

Dec. 16, 2004 (FR) ..... 04 13445

(51) Int. Cl.
*G05F 1/40* (2006.01)
*G05F 5/00* (2006.01)

(52) U.S. Cl. ..... 323/274; 323/280; 323/284; 323/303; 323/268

(58) Field of Classification Search ..... 323/225, 323/274, 280, 284, 299, 303, 306, 268, 269, 323/270

See application file for complete search history.

(56) References Cited

U.S. PATENT DOCUMENTS

| | | | | |
|---|---|---|---|---|
| 6,407,538 | B1 * | 6/2002 | Kinoshita et al. | 323/314 |
| 6,979,981 | B2 * | 12/2005 | Yoshikawa | 323/225 |
| 2008/0054864 | A1 * | 3/2008 | Crippa et al. | 323/269 |
| 2008/0094044 | A1 * | 4/2008 | Ji | 323/268 |

FOREIGN PATENT DOCUMENTS

| | | | |
|---|---|---|---|
| EP | 1 061 428 | B1 | 8/2005 |
| WO | WO 2004/092861 | A1 | 10/2004 |

* cited by examiner

*Primary Examiner*—Jessica Han
(74) *Attorney, Agent, or Firm*—Westman, Champlin & Kelly, P.A.

(57) ABSTRACT

A voltage regulator system is provided, which receives a first voltage and produces a regulated voltage. Such a device does not include any transistor supporting the first voltage, but does include transistors supporting at most a second voltage lower than the first voltage and includes division means, which include a first transistor connected in series with at least one second transistor, which division means receive the first voltage and generate the regulated voltage.

10 Claims, 4 Drawing Sheets

HIGH-VOLTAGE REGULATOR SYSTEM COMPATIBLE WITH LOW-VOLTAGE TECHNOLOGIES AND CORRESPONDING ELECTRONIC CIRCUIT

CROSS-REFERENCE TO RELATED APPLICATION

The present application claims priority of French Application No. FR 04/13445, filed Dec. 16, 2004, not in English.

FIELD OF THE DISCLOSURE

This disclosure relates to integrated electronic circuits and more specifically MOS circuits.

More precisely, the disclosure relates to techniques for regulating voltage in such mixed circuits including transistors operating with different voltage levels.

BACKGROUND OF THE DISCLOSURE

Integrated circuits have traditionally operated with a standard power supply of around 5 V. However, the growing need to reduce the size of integrated circuit-based electronic systems has led the designers of such circuits to reduce the standards for lithography and therefore for the power supply of transistors. Thus, transistors powered at 3 V or 1.8 V, for example, are used today.

However, it takes time to standardise supply voltages, and reducing the supply voltage is not given the same priority in all applications of the electronics industry. Therefore, currently, in an MOS integrated circuit, there are generally two voltages and two types of associated transistors. The inputs/outputs of these circuits are powered at a higher voltage than that powering their core. Thus, the input/output transistors are called "high-voltage transistors" and the core transistors are called "low-voltage transistors". The low-voltage transistors are smaller and can therefore be more densely integrated.

Two categories of electronic circuits are currently differentiated:

in the first category, the circuit includes, for its inputs/outputs, transistors powered at 5 V (called 5-V transistors) and, for its core, transistors powered at 3 V (called 3-V transistors);

in the second category, the circuit includes, for its inputs/outputs, transistors powered at 3 V and, for its core, transistors powered at 1.8 V (called 1.8-V transistors).

The 3-V or 1.8-V transistors of these circuits cannot reliably support the voltage supply of 5 V. Indeed, a 3-V transistor can support a maximum voltage of 3.6 V applied between its various components: drain, source, gate and case. Similarly, a 1.8-V transistor can support a maximum voltage of 2 V applied between its various components.

The circuits of the second category are made according to a newer and more precise technology (with patterns of approximately 0.18 μm) and are therefore more efficient than the circuits of the first category.

As the power supply of all of the circuits (first and second categories) is generally 5 V, it is suitable to use voltage regulators (also called voltage regulator systems) providing other voltage supplies (3-V and 1.8 V).

Thus, for a circuit of the first category, a 5V-3V voltage regulator is used, made with 5-V transistors integrated into the circuit, and enabling a voltage of 3 V to be provided from the 5-V power supply. This regulator is easy to produce because a circuit of the first category includes 5-V transistors at the level of its inputs/outputs. Indeed, the same technology and the same process steps can be used to produce both the 5-V transistors of the regulator and those of the inputs/outputs.

However, for a circuit of the second category, it is necessary to have two voltage regulators: a first 3V-1.8V regulator that is easy to produce so that it is integrated into the circuit (due to the presence of the 3-V circuit at the level of the inputs/outputs of the circuit), and a second 5V-3V regulator. This second regulator is not as easy to produce as the 3V-1.8V regulator due to the absence of the 5-V transistor at the level of the inputs/outputs.

A first known solution for producing the second 5V-3V regulator in a circuit of the second category consists of integrating, at the level of the inputs/outputs of the circuit, 5-V transistors so as to produce an integrated regulator such as that used for the circuits of the first category. However, to provide both 5-V transistors (of the regulator) and 3-V transistors (of the remainder of the inputs/outputs) in the inputs/outputs of such a circuit, it is necessary to implement a mixed technology that is expensive and involves a large number of process steps (compared with a single technology).

A second known solution is to use a 5V-3V regulator outside the circuit and produced through 5-V transistors. However, this technique is also expensive and bulky because the regulator is not integrated into the circuit.

SUMMARY

An embodiment of the present invention is directed to a voltage regulator system receiving a first voltage and producing a regulated voltage.

According to the embodiment, such a system includes no transistors supporting the first voltage, but does include transistors supporting at most a second voltage lower than the first voltage and includes division means, which include a first transistor connected in series to at least one second transistor, which division means receive the first voltage and generate the regulated voltage.

Thus, the embodiment is based on an entirely new and inventive approach to a regulator that can be easily and more economically integrated to an electronic circuit including transistors supporting the second voltage (for example, 3-V transistors), but not the first voltage (for example, 5-V) since it is constructed with transistors of the same type as those mentioned above (3-V transistors).

To do this, the first voltage is divided with series-connected transistors, so that each transistor included in the division means is not assigned an excessively high voltage.

Although the regulator according to the embodiment can be implemented outside the circuit, it is preferably integrated into the circuit. Indeed, in this case, it is simple and inexpensive to implement.

Moreover, the regulators according to one or more embodiments of the invention do not require the implementation of mixed technologies, which are expensive.

Advantageously, the voltage regulator system according to one or more embodiments of the invention also includes feedback control means enabling the state of the transistors included in the division means to be controlled according to the actual value of the regulated voltage.

The control means preferably include:

means for measuring a voltage, referred to as the measured voltage, dependent on the regulated voltage;

means for comparing the measured voltage with a predetermined reference voltage, which comparison means generate an output signal;

first and second control means acting respectively on the first and second transistors according to the output signal of the comparison means.

According to a feature of one or more embodiments of the invention, the control means also include means for generating the reference voltage, which generation means are powered by the regulated voltage.

The comparison means advantageously include a differential amplifier, which is powered by the regulated voltage.

According to an advantageous embodiment of the invention, the first control means act on a gate of the first transistor and the second control means act on a gate of the second transistor, so that they are both on if the measured voltage is lower than the reference voltage, or off if it is not.

The first control means preferably include means for amplifying the output voltage, so as to obtain a first control voltage acting on a gate of the first transistor.

The voltage regulator system according to the invention also advantageously includes means for starting up the voltage regulator system, which enable the first transistor to be turned on when the first voltage is applied to the system.

According to a feature of an embodiment of the invention, the start-up means include a transistor controlled by the regulated voltage.

According to an embodiment of the invention, the first voltage is equal to 5 V and the second voltage is equal to 3.3 V.

An embodiment of the invention also relates to an electronic circuit including a voltage regulator system as described above.

Other features and advantages of one or more embodiments of the invention will become more clear from the following description of a preferred embodiment, provided as an illustrative and non-limiting example, and the appended drawings.

DETAILED DESCRIPTION OF ILLUSTRATIVE EMBODIMENTS

The general principle of an embodiment of the invention is based on the use of two series-connected transistors that enable the voltage of a power supply to be divided and a regulated voltage to be produced. The transistors are controlled by a differential amplifier, associated with a voltage reference. The latter enables the channel of the two transistors to be opened or closed so as to control the regulated voltage.

Figure 1:
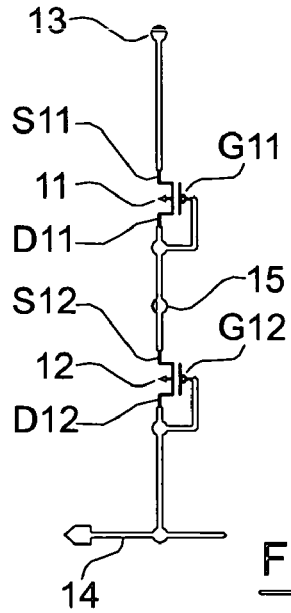
FIG. 1 shows the general principle of the invention implementing an assembly based on two power transistors.

FIG. 1 shows the general principle mentioned above implementing an assembly based on two power transistors.

This basic assembly includes a first and a second power P-MOS transistor 11, 12 connected in series, wherein the drain D11 of the first transistor 11 is connected to the source S12 of the second transistor 12. A power supply 13 of 5 V is connected to the source SO11 of the first transistor 11. A 0-V potential is imposed at an output voltage 14 connected to the drain D12 of the second transistor 12, in the context of said FIG. 1. The two transistors 11, 12 are 3-V transistors.

As the two transistors 11, 12 are diode-connected (their gate is connected to their drain), the voltage of the mid-point 15 of this assembly (drain D11 of the first transistor 11 or source S12 of the second transistor 12) is biased at around 2.5 V. Neither of the transistors 11, 12 has a voltage between two of its terminals exceeding 3.6 V. Thus, neither of them is stressed or runs the risk of being damaged by the 5-V potential of the power supply 13.

Consequently, the series connection of the two transistors 11, 12 enables the supply voltage 5 V to be divided so that each of them never has a potential difference greater than 3.6 V.

A voltage regulator system according to an embodiment of the invention can be produced on the basis of such an association of two series-connected transistors.

An example is given below of a USB circuit produced in particular with 3-V transistors and for which there is a power supply VUSB of 5 V, or, more specifically, capable of varying between 4.4 V and 5.5 V. Thus, in this circuit, it is necessary to have a 5V-3.3V voltage regulator system.

To produce a 5V-3.3V voltage regulator system using the series connection of transistors 11, 12 of FIG. 1, a precise and unvarying voltage of 3.3 V is provided at the output 14 of the regulator regardless of the level of the power supply 13 (between 4.4 V and 5.5 V), noted VUSB in this context, and regardless of the current to be provided at the output (capable of varying between 0 and 100 mA).

Thus, to precisely regulate the output voltage 14, hereinafter referred to as the regulated voltage, of such a regulator, an embodiment of the invention proposes adding to the assembly of FIG. 1, feedback control means (not shown in FIG. 1), which generate control voltages (not shown in FIG. 1) applied to the gates G11, G12 of the transistors 11, 12 (unlike in FIG. 1, the transistors are no longer diode-connected) so as to control them.

According to an embodiment of the invention, these feedback control means can be based on a differential amplifier associated with a voltage reference.

By controlling the state (on or off) of the transistors 11 and 12, as well as the current passing though them when they are on, the differential amplifier enables the regulated voltage to be controlled by varying the voltages at the terminals of the transistors 11, 12.

One problem, however, is that to turn off the first transistor 11 receiving the 5-V power supply at its source S11, it is necessary for the differential amplifier to provide a potential of at least 4.3 V (which corresponds to 5V-VT, where VT is the threshold voltage of the diode equivalent to the first transistor 11) at the gate G11 of the first transistor 11.

However, (like the 3-V transistors 11, 12) such a differential amplifier cannot support a supply voltage greater than 3.6 V and it is impossible for a differential amplifier to generate a voltage (>4.3 V) greater than the voltage by which it is powered (<3.6 V).

An alternative to this preferred embodiment (not shown), enabling this problem to be solved (not requiring the transistor 11 to be turned off), would be to use the differential amplifier in order to control only the gate G12 of the second transistor 12 (which would no longer be diode-connected), while the first transistor would still be diode-connected.

However, it is not always possible to provide a regulated voltage of 3.3 V regardless of the value of the supply voltage 13 and the current to be provided at the output of the regulator.

Indeed, according to this alternative, and even if a first transistor 11 is used at the limit of integrability with a large channel width (for example, 10,000 μm) and a second transistor 12 having a channel width of 4,000 μm, it is not possible, for example, to provide a regulated voltage of 3.3 V when the power supply VUSB is equal to 4.4 V and the current to be provided is 100 mA. Indeed, in this case, the mid-point 15 is equal to 3.2 V (it would be equal to 3.6 V for a low current) which, when a voltage of 200 mV is reduced at the terminals of the second transistor 12 (of which the channel is entirely open because the differential amplifier imposes 0 V on its gate G12), involves a regulated voltage of 3 V.

Below, it is described how the stated problem is solved in the context of the aforementioned implementation of feedback control means based on a differential amplifier.

Figure 2:
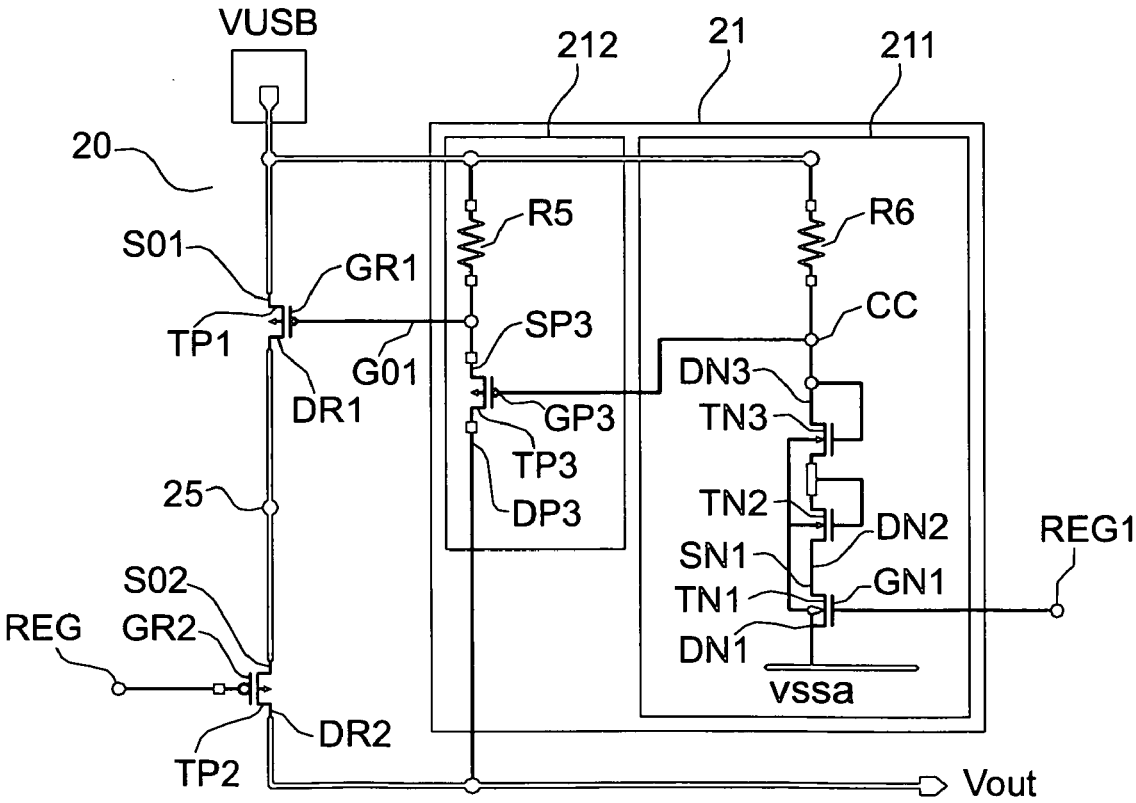
FIG. 2 shows a technique according to a preferred embodiment of the invention making it possible to control the first transistor of FIG. 1, powered at 5 V from a differential amplifier powered at 3.3 V.

To do this, FIG. 2 shows a technique according to an embodiment of the invention, whereby, from a first intermediate control voltage REG1 produced by a differential amplifier (not shown) powered by a regulated voltage Vout lower than 3.6 V, a first transistor TP1 powered by a supply voltage VUSB of 5 V can be controlled.

This technique is shown with a system 20 including the first power transistor TP1 and a second power transistor TP2 connected in series, as in FIG. 1. The second transistor TP2 is controlled by means of a second control voltage REG.

Figure 3:
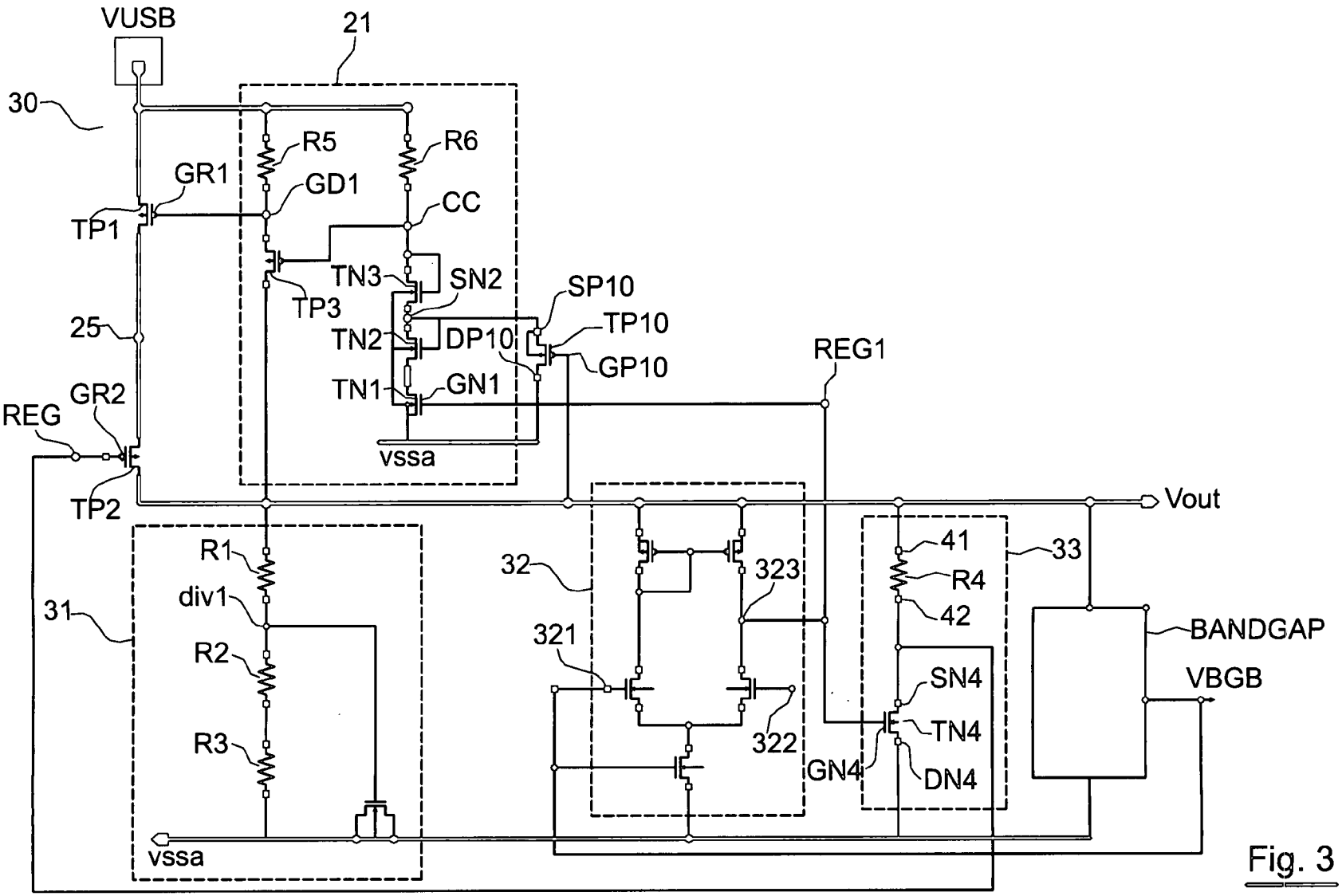
FIG. 3 shows a voltage regulator system 30 according to a preferred embodiment of the invention.

As shown in FIG. 3, the system 20 can serve as the basis for the production of a regulator according to an embodiment of the invention. In this case, means based on a differential amplifier (not shown in FIG. 2) enable the first intermediate control voltage REG1 and the second control voltage REG to be generated.

The first and second transistors TP1, TP2 are power P-MOS transistors, wherein the drain DR1 of the first transistor TP1 is connected to the source SO2 of the second transistor TP2, which is referred to as mid-potential 25. A power supply VUSB of 5 V is connected to the source SO1 of the first transistor TP1. The drain DR2 of the second transistor TP2 is connected to a regulated voltage Vout.

The two transistors TP1, TP2 are 3-V P-MOS transistors and are controlled at the level of their gate GR1, GR2, respectively by the application of a first control voltage GD1 and a second control voltage REG. These voltages GD1, REG thus make it possible to control the state, either off or on, of the two transistors TP1, TP2, as well as each of the currents passing through them when they are on.

The first control voltage GD1 is obtained at the output of an amplifier assembly 21 forming means for amplifying the first intermediate control voltage REG1.

The amplifier assembly 21 includes a first and a second amplification stage 211, 212. The first stage 211 includes a first amplification transistor TN1 of which the gate GN1 is connected to the first control voltage REG1 and of which the drain DN1 is connected to a potential reference vssa, equal to 0 V. Its source SN1 is connected to the drain DN2 of a second amplification transistor TN2, diode-connected and series connected with a third amplification transistor TN3, also diode-connected. The drain DN3 of the third amplification transistor is connected to a potential CC, which is connected to a first amplification resistance R6 of 50 KΩ. The first resistance R6 is also connected to the power supply VUSB.

The potential CC is also connected to the gate GP3 of a fourth amplification transistor TP3 included in the second amplification stage 212. The drain DP3 of the fourth amplification transistor TP3 is connected to the first control voltage GD1, which is connected to a second amplification resistance R5 of 50 KΩ. The second resistance is also connected to the power supply VUSB.

The first, second and third amplification transistors TN1, TN2, TN3 are N-MOS transistors having channel widths of 4 μm, 4 μm and 6 μm, respectively. The fourth amplification transistor is a P-MOS transistor having a channel width of 20 μm.

The second and third amplification transistors TN2, TN3, which are diode-connected, make it possible to prevent a voltage of 0 V from being applied (when a strong current is circulating in the first amplification transistor TN1) at the gate GP3 of the fourth transistor TP3. Indeed, this would cause the latter to break down.

If the first amplification transistor TN1 is turned on by the first intermediate control voltage REG1 (for this purpose equal to 1.8 V), then the potential CC is around two times the threshold voltage of one of the two diodes equivalent to the second and third amplification transistors TN2, TN3, and it is therefore close to 2 V. Thus, the fourth amplification transistor TP3 is turned on, enabling the first transistor TP1 to be turned on.

If the first amplification transistor TN1 is turned off by the first intermediate control voltage REG1 (for this purpose equal to 0 V), then the potential CC is close to the supply voltage VUSB, i.e. close to 5 V. Thus, the fourth amplification transistor TP3 is off, enabling the first transistor TP1 to be turned off.

Thus, the amplifier assembly 21 makes it possible to amplify the first intermediate control voltage REG1 and thus to obtain a first control voltage GD1 which is relatively high (>4.3 V) so as to be capable of turning off the first transistor TP1 in the system 20.

The amplifier assembly 21 therefore makes it possible to control the first transistor TP1 powered by a high supply voltage VUSB by means of a lower first intermediate control voltage REG1 while preventing this transistor from breaking down due to the application of an excessively low voltage at its gate.

A voltage regulator system 30 according to an embodiment of the invention in which feedback control means based on a differential amplifier are implemented will be described in relation to FIG. 3.

As indicated above (with regard to FIG. 2), the voltage regulator system 30 includes the system 20, as well as a start-up transistor TP10, forming a means for starting up the voltage regulator system 30. The latter is controlled at the level of its gate GP10 by the regulated voltage Vout, its drain DP10 is connected to the reference potential vssa and its source SP10 is connected to the source SN2 of the second amplification transistor TN2.

The feedback control means include first and second control means.

The first control means include amplification means 21. The latter receive, at the gate GN1 of the first amplification transistor TN1, the first intermediate control voltage REG1 and produce the control voltage GD1 at the gate GR1 of the first transistor TP1.

The feedback control means also include means 31 for measuring a measured voltage div1 which is proportional to the regulated voltage Vout. These measuring means 31 include a first, a second and a third measurement resistance R1, R2, R3 of 51 KΩ 500 Ω and 29.5 KΩ, respectively, which are connected in series. The first measurement resistance R1 is connected to the regulated voltage Vout. The third measurement resistance R3 is connected to the reference potential vssa. The measured voltage div1 is the voltage at the terminals of the second and third measurement resistances R2, R3. It is therefore proportional to the regulated voltage Vout according to a proportionality ratio equal to the sum of the second and third measurement resistances R2, R3 to the sum of the first, second and third measurement resistances R1, R2, R3.

The feedback control means also include means (referenced BANDGAP) for generating a reference voltage VBGP equal to 1.2 V. These means are powered by the regulated voltage Vout and connected to the reference potential vssa.

The values of the measurement resistances R1, R2, R3 are selected so that the measured voltage div1 is equal to the reference voltage VBGP when the regulated voltage Vout is equal to the voltage to be obtained at the output of the regulator, i.e. 3.3 V, hereinafter referred to as the desired value.

The feedback control means also include means for comparing the measured voltage div1 with the reference voltage VBGP.

These comparison means include a differential amplifier 32, powered by the regulated voltage Vout, of which a first input 321 receives the measured voltage div1 and a second input 322 receives the reference voltage VBGP. The output 323 (second input side) of the amplifier 32 produces the first intermediate control voltage REG1 at the gate GN1 of the first amplification transistor TN1.

The second control means 33 include a control resistance R4 connected, at a first end 41, to the regulated voltage Vout and at a second end 42 to the source SN4 of a control transistor TN4 of which the drain DN4 is connected to the reference potential vssa and the gate GN4 is connected to the output 323 of the amplifier 32.

The source SN4 of the control transistor TN4 produces the second control voltage REG at the gate GR2 of the second transistor TP2.

The operation of the voltage regulator system 30 will now be described in detail in relation to FIGS. 4, 5 and 6.

Figure 4:
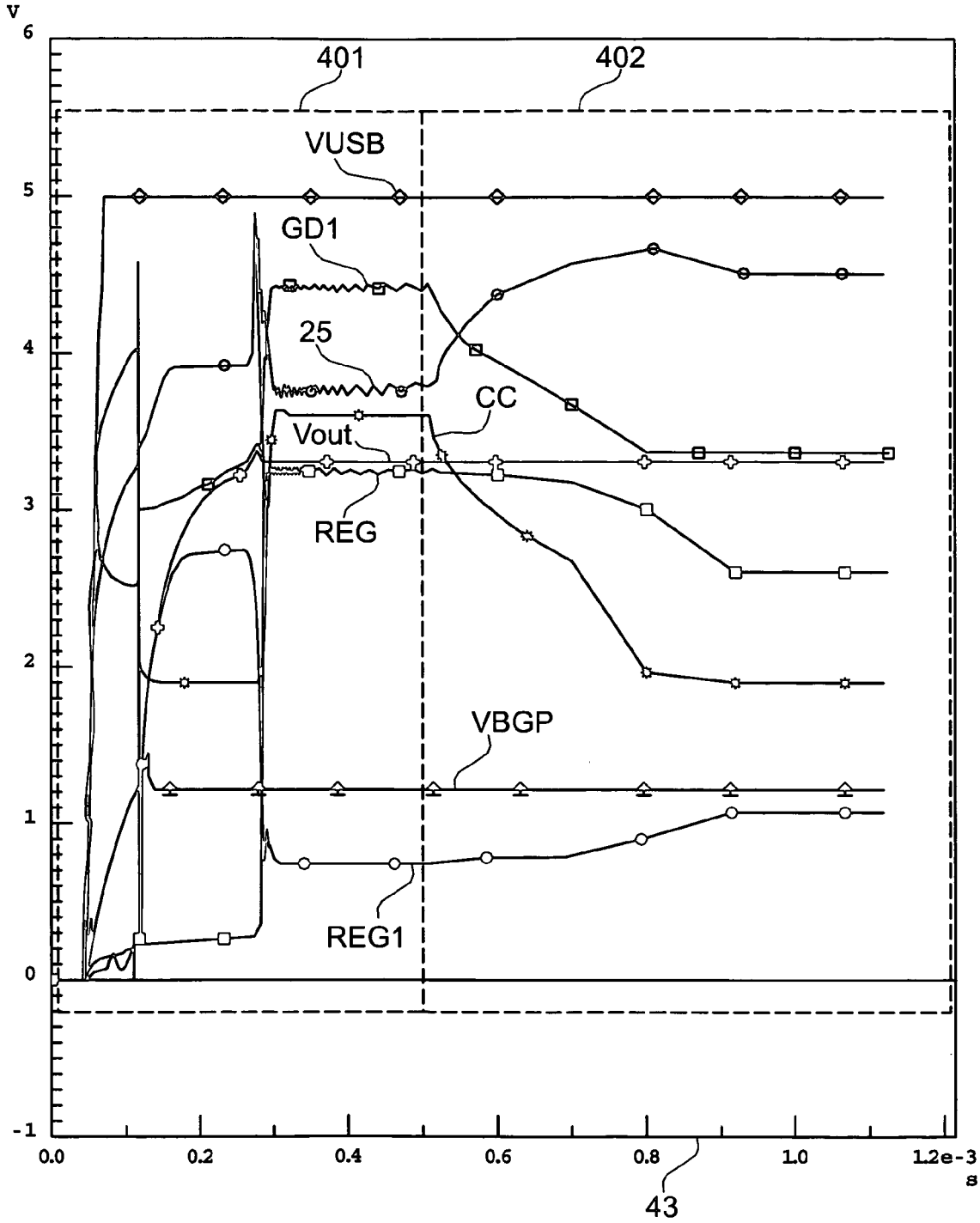
FIG. 4 is a set of graphs showing the change over time of a plurality of voltages characteristic of the system of FIG. 3 at the start-up of the regulation as well as when a load, placed at the output of the regulator, causes a linear current draw from 0 mA to 150 mA at the output of the regulator.

FIG. 4 shows the change over time in the characteristic voltages including:

the supply voltage VUSB;
the reference voltage VBGP;
the first intermediate control voltage REG1;
the first control voltage GD1;
the second control voltage REG;
the potential CC;
the mid-potential 25; and
the regulated voltage Vout,
as a function of time 43.

For illustrative purposes, the following are distinguished in FIG. 4:

a first time interval 401 (ranging from 0 s to $0.5*10^{-3}$ s) which corresponds to the start-up of the voltage regulator system 30, when the power supply VUSB goes from 0 V to 5 V; and a second time interval 402 (ranging from $0.5*10^{-3}$ s to $1.2*10^{-3}$ s) during which a load placed at the output of the regulator causes a linear current draw 60 from 0 to 150 mA at the output of the regulator.

First, the change in the aforementioned characteristic voltages will be described for the first time interval 401 (start-up of the voltage regulator system 30).

The start-up transistor TP10 enables the first transistor TP1 to be turned on when the voltage regulator system 30 has been powered by means of the supply voltage VUSB. Indeed, in this case, the regulated voltage Vout is equal to 0 V and cannot power the differential amplifier 32 or even the voltage reference. Thus, the first control means cannot control the first amplification transistor TN1 and consequently cannot turn the first transistor TP1 on.

To overcome this problem at the start-up, the start-up transistor TP10, controlled by the regulated voltage Vout, circulates a current in the first amplification resistance R6, which reduces the potential CC and thus enables the fourth amplification transistor TP3 to be turned on, and thus the first transistor TP1 to be turned on.

The fact that the first transistor TP1 is on causes the regulated voltage Vout to increase. The generation means BANDGAP begin to produce the reference voltage VBGP at 1.2 V when the regulated voltage Vout reaches 1.4 V. the differential amplifier 32 begins to operate only when the regulated voltage Vout reaches 1.8 V.

Therefore, when the regulated voltage Vout reaches 1.8 V, the feedback control means take control of the first and second transistors TP1, TP2 so as to continue to increase the regulated voltage Vout until it reaches the desired value of 3.3 V, beyond which they close the first and second transistors TP1, TP2 so as to stabilise the regulated voltage.

When the regulated voltage Vout reaches 2.5 V, the start-up transistor TP10 is turned off.

It will now be described how the regulated voltage Vout is reset to its desired value of 3.3 V when a load placed at the output of the regulator, for example, tends to vary the regulated voltage.

Next, transistors that are open when they are on and transistors that are closed when they are off will be discussed.

When the regulated voltage Vout becomes lower than its desired value of 3.3 V, the measured voltage div1, which is proportional to the latter, becomes lower than the value of the reference voltage VBGP of 1.2 V, and thus, the first intermediate control voltage REG1 (at the output of the differential amplifier 32 of the comparator assembly) increases. This causes the first amplification transistor TN1 to open when it reaches 1.8 V, which causes the fourth amplification transistor TP3 to open, causing the first transistor TP1 to open. This also causes the second control voltage REG to be reduced, thus causing the second transistor TP2 to open.

The openings of the first and second transistors TP1, TP2 cause an increase in the regulated voltage until it reaches its desired value of 3.3 V.

However, when the regulated voltage Vout exceeds the desired value of 3.3 V, then the measured voltage div1 becomes higher than the reference voltage value VBGP, and, therefore, the first intermediate control voltage REG1 (at the output of the differential amplifier 32 of the comparator assembly) decreases. This causes the first amplification transistor TN1 to close when it nears 0 V, which causes the fourth amplification transistor TP3 to close, causing the first transistor TP1 to close. This also causes the second control voltage REG to increase to approximately 3.3 V, which means that the second transistor TP2 is used as a diode.

The closure of the first transistor TP1 results in a decrease in the regulated voltage until it reaches its desired value of 3.3 V.

In this way, a 5V-3.3V regulator integrated into a 3-V transistor technology is produced.

In the second time interval 402 mentioned above and shown in FIG. 4, it is possible to see the change in regulated voltage Vout (see FIG. 5, which is specific to the latter), good regulation at 3.3 V of the voltage regulator system 30 when the linear current draw 60 (from 0 mA to 150 mA) is caused by the load placed at the output of the regulator starting at 0.5 ms.

Indeed, at the end of slightly less than 0.3 ms, the regulated voltage Vout is constant and equal to 3.3 V in spite of the current draw caused by the load placed at the output of the regulator starting at 0.5 ms. The current draw 60 mentioned above is shown in FIG. 6, which shows the linear change in this current as a function of time 43.

Figure 5:
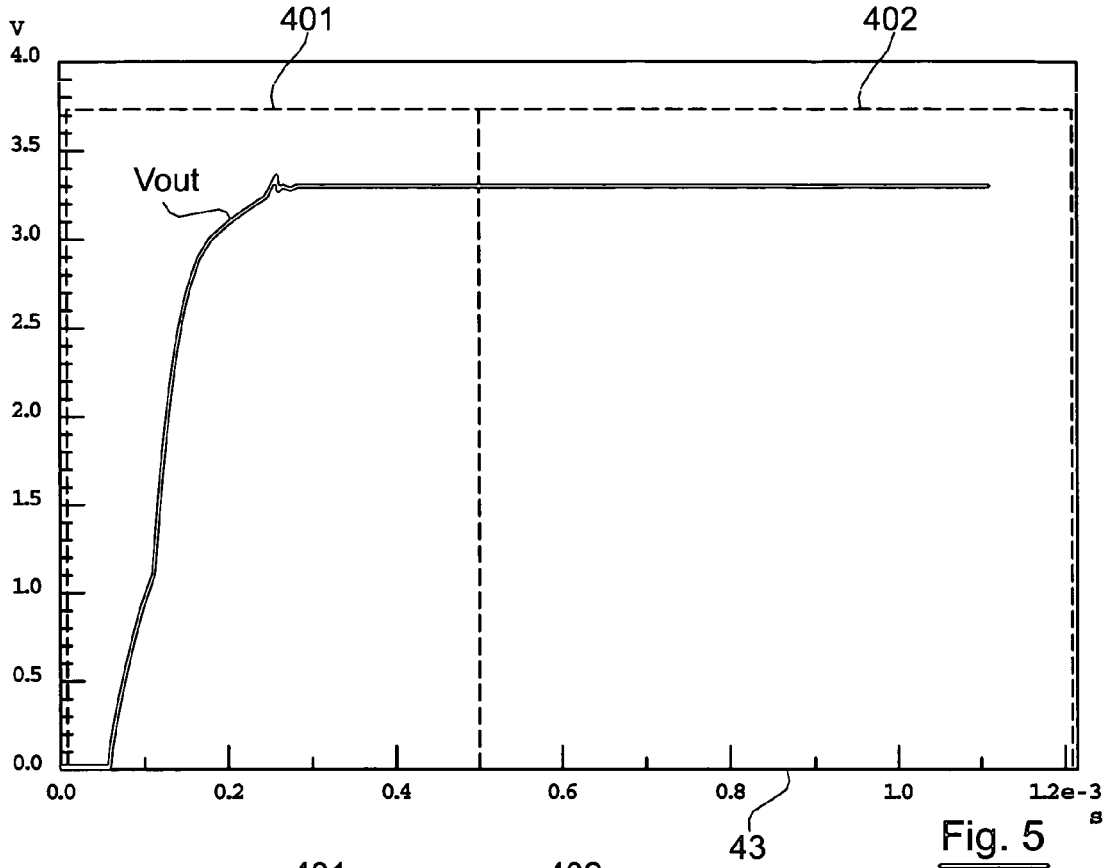
FIG. 5 shows the change over time of the regulated voltage Vout (under the conditions of FIG. 4) independently of the other characteristic voltages presented in FIG. 4.
Figure 6:
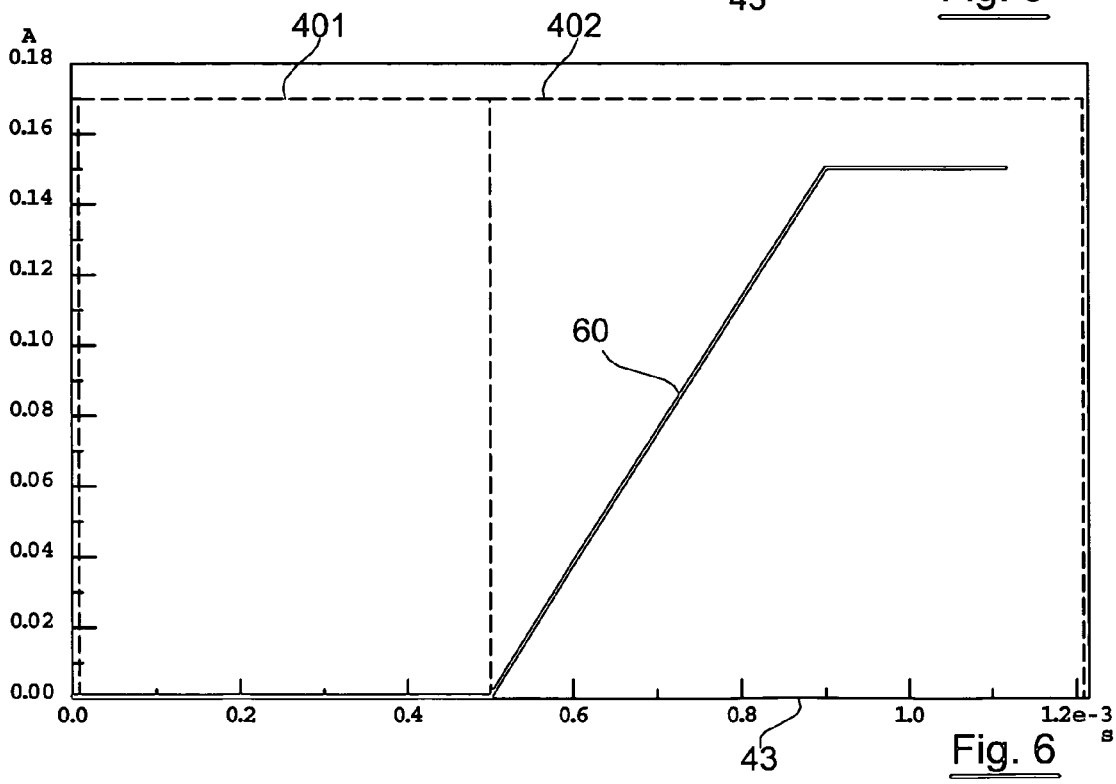
FIG. 6 shows the aforementioned current draw.

In the graphs of FIGS. 4 and 5, it can be seen that the signals are not perfectly stable, and several oscillations can indeed be seen on these curves. According to alternatives to this embodiment of the voltage regulator system, it is possible to add circuit elements so as to stabilise these signals.

Of course, the invention is not limited to the examples mentioned above.

For example, a person skilled in the art can make any modification to the comparison means in particular by implementing a comparator based on an operational amplifier.

Similarly, the amplification means can be produced in any other way, in particular with an operational amplifier.

The transistors of the examples mentioned above can be replaced by any type of transistor, and in particular field-effect transistors. The type of transistors mentioned can be reversed, and thus P-transistors can be used in place of N-transistors and vice-versa, according to the intended applications.

In summary, one or more embodiments of the invention provide a new technique whereby it is possible to provide effective voltage regulation from a first to a second voltage (typically 5-V to 3-V) and not including transistors supporting the first voltage. For example, one or more embodiments implement such a technique that enables the regulator to be integrated into a circuit powered by the first voltage. One or more embodiments also provide such a technique that occupies only a small silicon surface and that does not require any additional process steps. One or more embodiments also provide such a technique that is simple to implement and inexpensive.

Although the present invention has been described with reference to preferred embodiments, workers skilled in the art will recognize that changes may be made in form and detail without departing from the spirit and scope of the invention.

What is claimed is:

1. A voltage regulator system receiving a first voltage and producing a regulated voltage, wherein the system comprises:

transistors capable of being powered at, at most, a second voltage, which is lower than said first voltage, without comprising any transistor capable of being powered at said first voltage;

division means, including a first transistor connected in series with at least one second transistor, which division means receive said first voltage and generate said regulated voltage; and feedback control means permitting to control a state, of the transistors included in the division means according to an actual regulated voltage value, wherein said feedback control means include:

means for measuring a voltage, referred to as a measured voltage, dependent on said regulated voltage; and means for comparing said measured voltage with a predetermined reference voltage, which comparison means produce an output signal.

2. An electronic circuit comprising a voltage regulator system according to claim 1.

3. The voltage regulator system according to claim 1, wherein said control means include:

first and second control means acting on said first and second transistors, respectively, according to the output signal of the comparison means.

4. The voltage regulator system according to claim 3, wherein said control means also include means for generating said reference voltage, which generation means are powered by said regulated voltage.

5. The voltage regulator system according to claim 3, wherein said comparison means include a differential amplifier, which is powered by said regulated voltage.

6. The voltage regulator system according to claim 3, wherein the first control means act on a gate of the first transistor and the second control means act on a gate of the second transistor, so that they are both on if said measured voltage is lower than the reference voltage, or off if said measured voltage is higher than the reference voltage.

7. The voltage regulator system according to claim 3, wherein said first control means include means for amplifying said output voltage, so as to obtain a first control voltage acting on a gate of the first transistor.

8. The voltage regulator system according to claim 1, wherein the system also includes means for starting up said voltage regulator system, which start-up means enable said first transistor to be turned on when the first voltage is applied to said device.

9. The voltage regulator system according to claim 8, wherein said start-up means include a transistor controlled by said regulated voltage.

10. The voltage regulator system according to claim 1, wherein said first voltage is equal to 5 V and said second voltage is equal to 3.3 V.

* * * * *